US006799882B2

(12) United States Patent
Childers et al.

(10) Patent No.: US 6,799,882 B2
(45) Date of Patent: Oct. 5, 2004

(54) MIXING APPARATUS FOR INJECTING FLUID INTO A GAS STREAM

(75) Inventors: Winthrop D. Childers, San Diego, CA (US); Mark A. Van Veen, Cardiff by the Sea, CA (US); Steven W Steinfield, San Diego, CA (US); Mohammad M Samii, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 249 days.

(21) Appl. No.: 10/138,063

(22) Filed: May 1, 2002

(65) Prior Publication Data

US 2003/0206483 A1 Nov. 6, 2003

(51) Int. Cl.[7] ..... B01F 3/04; B01F 5/04; B01F 15/02

(52) U.S. Cl. ..... 366/151.1; 366/167.1; 366/173.1; 261/26; 422/124

(58) Field of Search ..... 366/173.1, 173.2, 366/167.1, 151.1, 144; 422/124; 261/26, DIG. 65, DIG. 88

(56) References Cited

U.S. PATENT DOCUMENTS

| | | | | | |
|---|---|---|---|---|---|
| 4,929,400 | A | * | 5/1990 | Rembaum et al. | 264/10 |
| 5,158,716 | A | * | 10/1992 | Hirokane | 261/DIG. 48 |
| 5,591,409 | A | * | 1/1997 | Watkins | 422/124 |
| 5,604,519 | A | | 2/1997 | Keefe et al. | 347/13 |
| 5,812,159 | A | * | 9/1998 | Anagnostopoulos et al. | 347/55 |
| 5,870,124 | A | * | 2/1999 | Silverbrook | 347/85 |
| 5,949,522 | A | * | 9/1999 | Manne | 261/26 |
| 6,231,032 | B1 | * | 5/2001 | Ivey, Jr. | 261/26 |
| 6,390,453 | B1 | * | 5/2002 | Frederickson et al. | 261/26 |
| 6,394,575 | B1 | | 5/2002 | Kent | |

* cited by examiner

*Primary Examiner*—Tony G. Soohoo

(57) ABSTRACT

A mixing apparatus having a channel for guiding an input gas stream, a drop on demand fluid drop emitting apparatus for emitting drops of a fluid into the input gas stream to produce a gas mixture that contains the fluids drops, and a pressure control system for controlling a pressure of the fluid in the drop on demand fluid drop emitting apparatus.

39 Claims, 5 Drawing Sheets

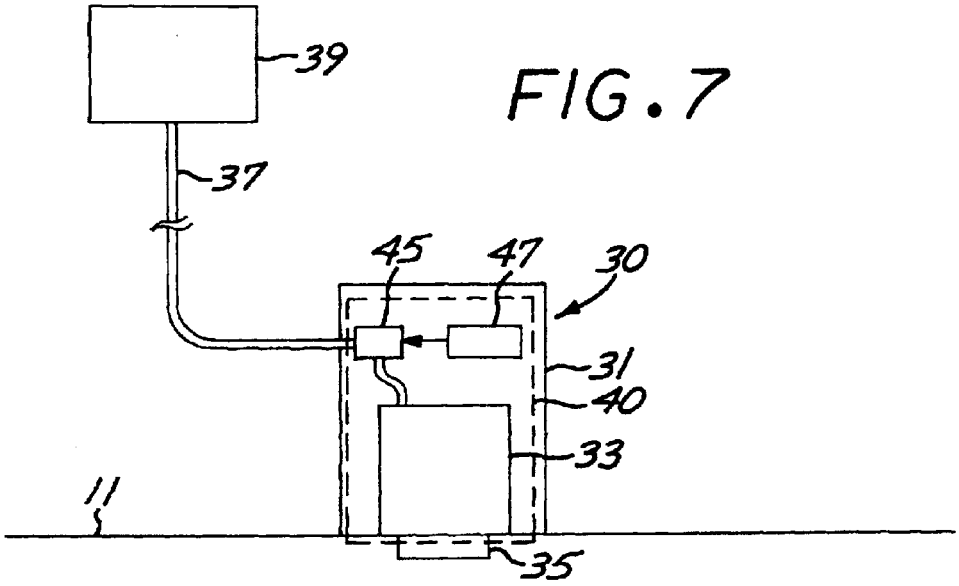
FIG. 7
FIG. 8
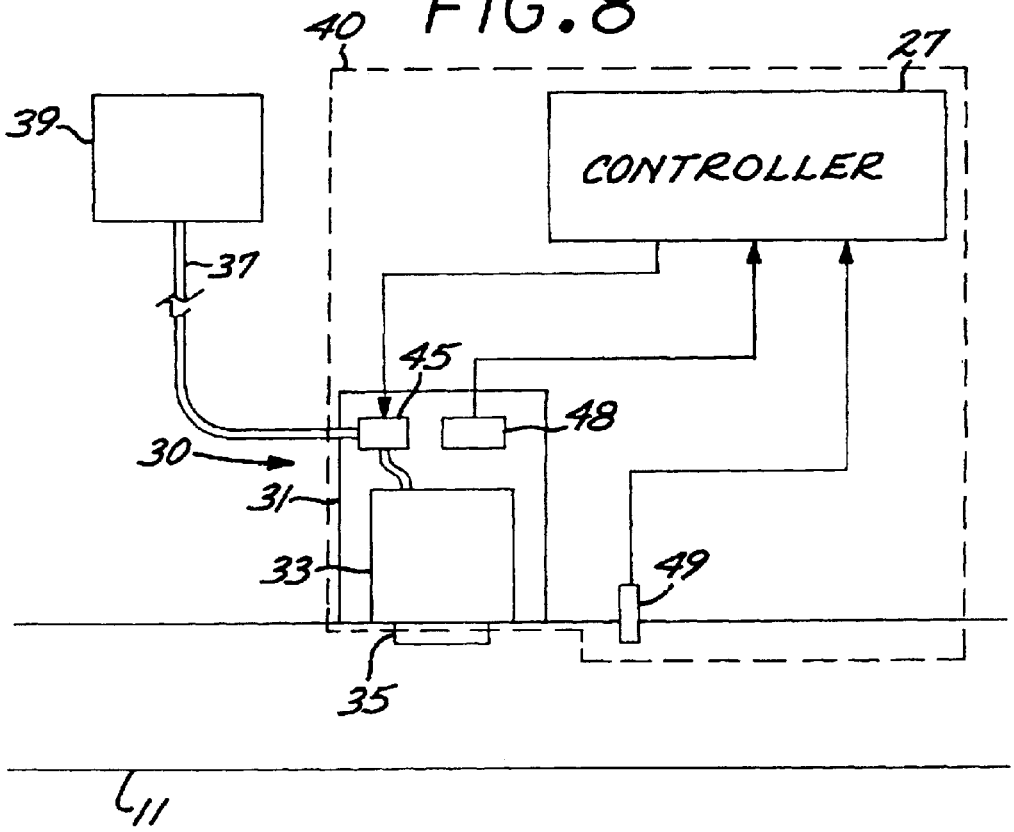

MIXING APPARATUS FOR INJECTING FLUID INTO A GAS STREAM

BACKGROUND OF THE DISCLOSURE

The disclosure is generally directed to mixing apparatus that employs drop on demand fluid drop emitting apparatus to introduce drops of a fluid into a gas stream.

Fluids are commonly mixed with gases in a variety of industrial processes, and it is often difficult to control the amount of fluid that is added to a gas.

BRIEF DESCRIPTION OF THE DRAWINGS

Advantages and features of the disclosure will readily be appreciated by persons skilled in the art from the following detailed description when read in conjunction with the drawing wherein:

FIG. 7 is a schematic block schematic block diagram of an embodiment of a drop on demand fluid drop emitting device that includes a pressure control system having a pressure regulating valve and a valve actuator.

FIG. 8 is a schematic block schematic block diagram of an embodiment of a drop on demand fluid drop emitting device that includes a pressure control system having a pressure regulating valve and pressure transducers.

DETAILED DESCRIPTION OF THE DISCLOSURE

Figure 1:
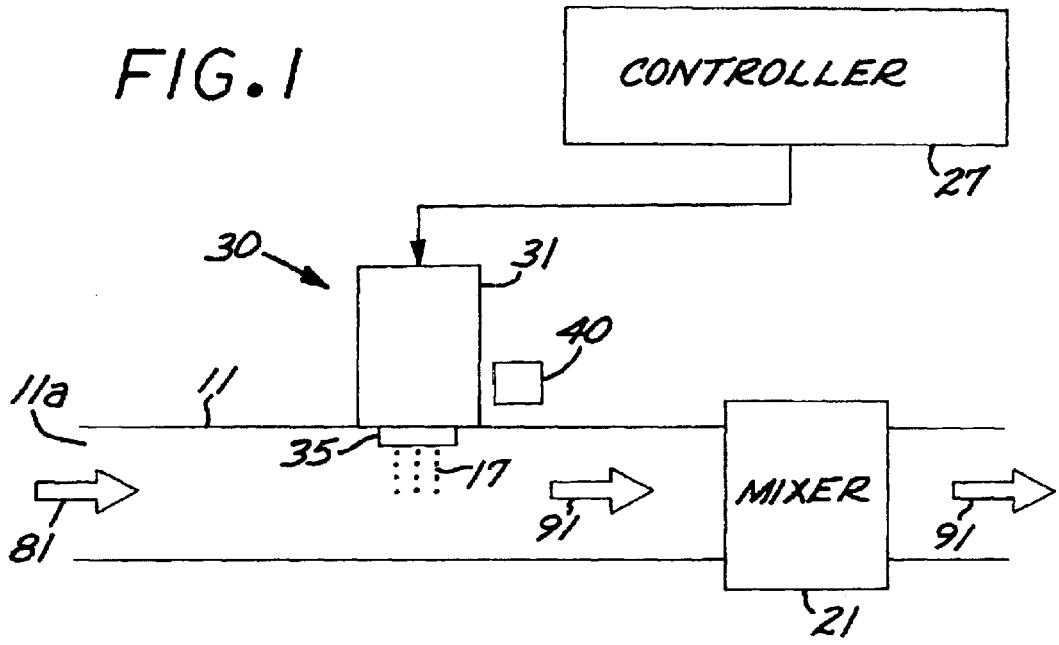
FIG. 1 is a schematic block diagram of an embodiment of a mixing apparatus that employs a drop on demand fluid drop emitting device.

FIG. 1 is a schematic block diagram of an embodiment of a mixing apparatus that includes a channel, duct or conduit 11 that guides an input gas or compressible fluid stream 811 to flow from an input 11 a toward a mixer or turbulator 21. A drop on demand drop emitting device 30 emits drops of an additive fluid component 17, for example as an aerosol, into the input gas stream 81 flowing in the conduit 11 to produce a gas mixture 91 that contains drops of the additive fluid component 17. The gas mixture 91 that contains drops of the additive fluid component 17 is further mixed by the mixer 21 which can comprise a spiral mixing duct, or a series of baffles, for example. Alternatively, the mixer 21 can be omitted if further mixing is not needed for the particular use of the mixing apparatus. A controller 27 controls the operation of the drop on demand fluid drop emitting device 30, for example to control the amount of the fluid component 17 injected into the input gas stream 81. The drop emitting device 30 includes a body 31 and a drop on demand fluid drop emitter structure 35 that is supported or housed by the body 31.

The fluid drop emitter structure 35 can be a plurality of electrically addressable fluid drop generators that are selectively controlled by control signals provided by the controller 27 to emit drops of an additive fluid component 17. The fluid drop emitter structure 35 can comprise for example a thermal drop emitter structure or a piezoelectric drop emitter structure similar to thermal or piezoelectric ink drop emitting printheads employed in ink jet printers.

A suitable thermal drop on demand drop emitter structure 35 can include, for example, an array of nozzles or openings in an orifice structure that is attached to or integral with a fluid barrier structure that in turn is attached to a thin film substructure that implements drop firing heater resistors and apparatus for enabling the resistors. The fluid barrier structure can define fluid flow control structures., particle filtering structures, fluid passageways or channels, and fluid chambers. The fluid chambers are disposed over associated fluid drop firing resistors, and the nozzles in the orifice structure are aligned with associated fluid chambers such that thermal drop generators are formed of respectively associated heater resistors, fluid chambers and nozzles. To emit a fluid drop, a selected heater resistor is energized with electric current. The heater resistor produces heat that heats fluid in the adjacent fluid chamber. When the fluid in the chamber reaches vaporization, a rapidly expanding vapor front forces fluid within the fluid chamber through an adjacent orifice. An example of a thermal drop generator employed in thermal ink jet printing can be found in commonly assigned U.S. Pat. No. 5,604,519.

The use of electrically addressable drop on demand drop generators can provide for accurate volumetric drop dispensing.

The embodiment shown in FIG. 1 can also include a pressure control system 40 that regulates the pressure of fluid in the drop emitter structure 35 such that the drop emitter structure 35 can properly operate in the conduit 11. The pressure of the fluid in the drop emitter structure 35 can be controlled to be positive or negative relative to the pressure in the conduit 11, depending upon the type of fluid drop emitter structure 35 employed. For example, if a thermal drop emitter structure is employed, then the pressure of the fluid in the drop emitter structure 35 relative to the pressure in the conduit 11 can be controlled to be negative. Some piezo-electric type drop emitter structures may require a positive pressure with respect to the pressure in the conduit 11. The control of pressure can be closed loop or open loop. The details of various embodiments of pressure control system 40 will be described later in FIGS. 6–9.

Figure 2:
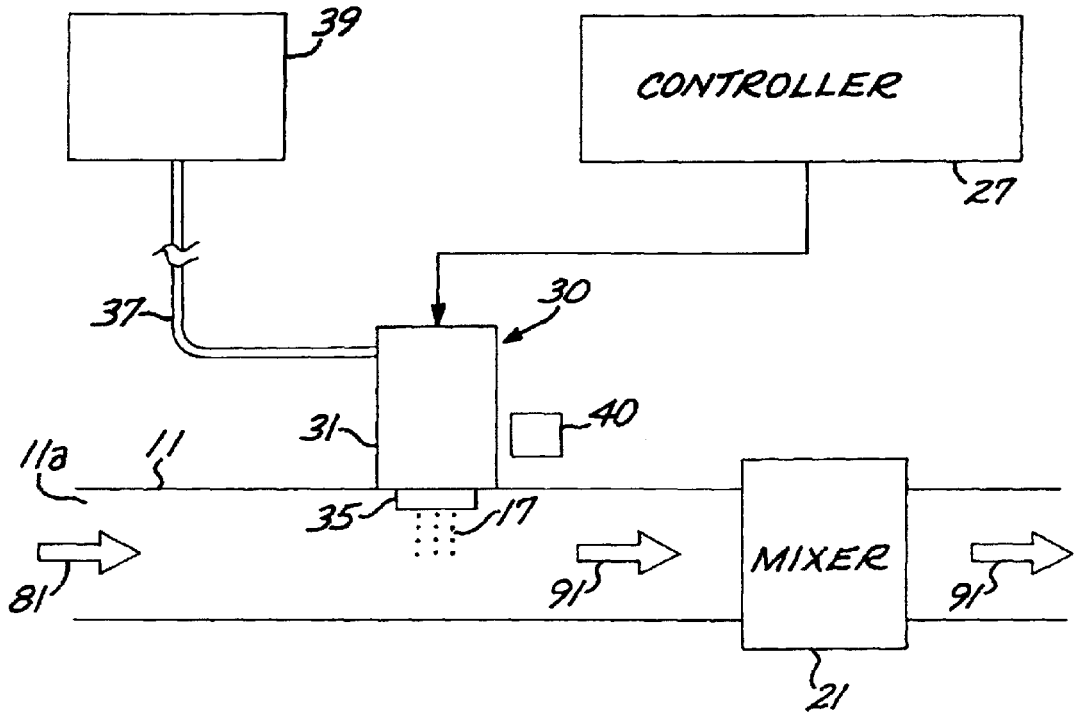
FIG. 2 is a schematic block diagram of an embodiment of a mixing apparatus that employs a drop on demand fluid drop emitting device that receives fluid from a fluid reservoir that is located remotely or separately from the drop on demand fluid drop emitting device.

FIG. 2 is a schematic block diagram of an embodiment of a mixing apparatus that includes a gas channel, duct or conduit 11 that guides an input gas or compressible fluid stream 81 to flow from an input 11*a* toward a mixer or turbulator 21. A drop on demand drop emitting device 30 emits drops of an additive fluid component 17, for example as an aerosol, into the input gas stream 81 flowing in the conduit 11 to produce a gas mixture 91 that contains drops of the additive fluid component 17. The gas mixture 91 that contains drops of the additive fluid component 17 is further mixed by the mixer 21 which can comprise a spiral mixing duct, or a series of baffles, for example. Alternatively, the mixer 21 can be omitted if further mixing is not needed for the particular use of the mixing apparatus. A controller 27 controls the operation of the drop on demand fluid drop emitting device 30, for example to control the amount of the fluid component 17 injected into the input gas stream 81. The drop emitting device 30 can be like the drop emitting device 30 of an embodiment of a mixing apparatus shown in FIG. 1 and includes a body 31 and a drop on demand fluid drop emitter structure 35 that is supported or housed by the body 31. An additive fluid reservoir 39 that is off-axis, separate or remote from the drop emitting device 30 contains an amount of the additive fluid 17 and is fluidically connected to the drop emitting device 30 by a conduit 37 that can be a flexible tube, for example. The off-axis additive fluid reservoir 39 can be pressurized, and can be replaceable separately from the drop emitting device 30.

Figure 3:
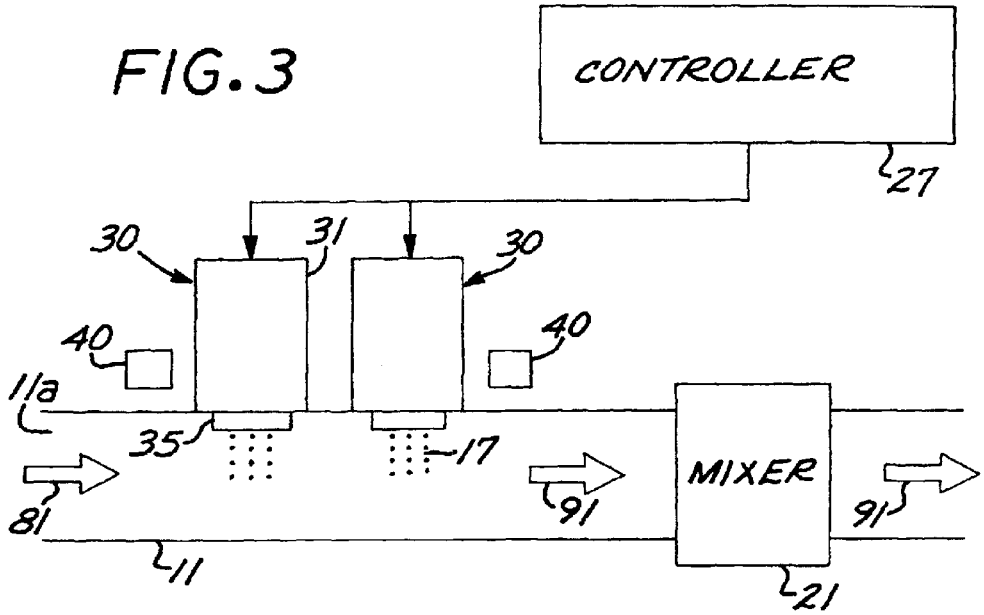
FIG. 3 is a schematic block diagram of an embodiment of a mixing apparatus that employs a plurality of drop on demand fluid drop emitting devices.

FIG. 3 is a schematic block diagram of an embodiment of a mixing apparatus that includes a channel, duct or conduit 11 that guides an input gas or compressible fluid stream 81 to flow from an input 11*a* toward a mixer or turbulator 21. A plurality of drop emitting devices 30 emit respective additive fluid components 17, for example as an aerosol, into the input gas stream 81 flowing in the conduit 11 to produce a gas mixture 91 that contains drops of the additive fluid components 17. The gas mixture 91 that contains drops of the additive fluid components 17 is further mixed by the mixer 21 which can comprise a spiral mixing duct, or a series of baffles, for example. Alternatively, the mixer 21 can be omitted if further mixing is not needed for the particular use of the mixing apparatus. A controller 27 controls the operation of the drop on demand fluid drop emitting devices 30, for example to control the amount of the fluid component 17 injected into the input gas stream 81. Each drop emitting device 30 can be like the drop emitting device 30 of an embodiment of a mixing apparatus shown in FIG. 1 and includes a body 31 and a drop on demand fluid drop emitter structure 35 that is supported or housed by the body 31. Each of the drop emitting devices 30 can emit drops of the same fluid component 17 as the other drop emitting devices 30, or it can emit drops of a different fluid component. One or more of the drop emitting devices 30 can be fluidically connected to a respective off-axis reservoir like the drop emitting device 30 of the embodiment of a mixing apparatus illustrated in FIG. 2.

Figure 4:
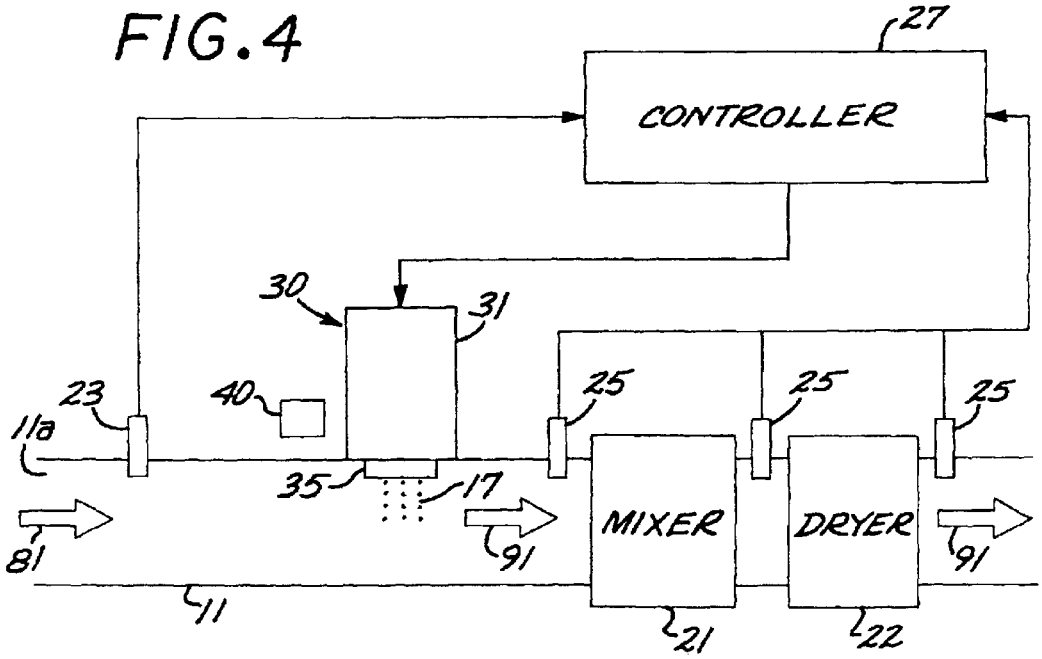
FIG. 4 is a schematic block diagram of another embodiment of a mixing apparatus that employs a drop on demand fluid drop emitting device.

FIG. 4 is a schematic block diagram of an embodiment of a mixing apparatus that includes a channel, duct or conduit 11 that guides an input gas or compressible fluid stream 81 to flow from an input 11*a* toward a mixer or turbulator 21. A drop emitting device 30 emits drops of an additive fluid component 17, for example as an aerosol, into the input gas stream 81 flowing in the conduit 11 to produce a gas mixture 91 that contains drops of the fluid component 17. The gas mixture 91 that contains drops of the additive fluid component 17 is further mixed by the mixer 21 which can comprise a spiral mixing duct, or a series of baffles, for example. Alternatively, the mixer 21 can be omitted if further mixing is not needed for the particular use of the mixing apparatus. The gas mixture 91 can be dried by a dryer 22 which removes liquid from the drops of the fluid component 17 in the gas mixture 91. Those skilled in the art will appreciate that the dryer 22 can be implemented in many different ways, such as via a condensing loop, a heating element, or by introducing drier air into the gas mixture 91, among other options. The drop emitting device 30 can be like the drop emitting device 30 of an embodiment of a mixing apparatus shown in FIG. 1 and includes a body 31 and a drop on demand fluid drop emitter structure 35 that is supported or housed by the body 31.

An input sensor 23 can be employed to sense or detect one or more parameters or characteristics of the input gas stream 81 before drops of the additive fluid component 17 are introduced, for example by sampling the input gas stream 81. One or more output sensors 25 can be employed to sense or detect one or more parameters or characteristics of the gas mixture 91, for example after any further mixing and/or after any drying. Examples of parameters or characteristics that can be detected or sensed include pH, humidity, temperature, density, particle count, bacteria count, and flow rate. Other examples would include color, particle size, optical density, and reflectivity.

A controller 27 controls the operation of each drop on demand fluid drop emitting device 30, for example to control the amount of the fluid component 17 injected into the input gas; stream 81. The operation of the drop on demand drop emitting device 30 can be adjusted in response to information received from any input sensor 23 and/or output sensor(s) 25 that are employed.

The embodiment of a mixing apparatus illustrated in FIG. 4 can be modified to include an off-axis reservoir and a conduit that fluidically connects the drop emitting device 30 to the off-axis reservoir, like the embodiment of a mixing apparatus illustrated in FIG. 2. The embodiment of the mixing apparatus illustrated in FIG. 4 can also be modified to include a plurality of drop emitting devices 30, like the embodiment of a mixing apparatus illustrated in FIG. 3. Each of such drop emitting devices can be fluidically connected an off-axis reservoir, like the drop emitting device 30 of the embodiment of a mixing apparatus illustrated in FIG. 2.

A use of the embodiments of a mixing apparatus illustrated in FIGS. 1–4 would be adjusting the pH of the input gas stream, for example by injecting drops of an acidic or basic additive fluid. The controller 27 can control the operation of the drop emitting devices 31 pursuant information received from an input sensor comprising a pH detector and/or an output sensor comprising a pH detector. A specific application would be treatment of an exhaust stream that is for example acidic, in which case the mixing apparatus would substantially neutralize the exhaust. This could be important for environmental reasons (e.g., to prevent acidic exhaust from being released into the atmosphere), or for maintenance reasons (e.g., to prevent the exhaust from corroding components that transport the exhaust.

Another use of the embodiments of a mixing apparatus illustrated in FIGS. 1–4 would be manufacturing a dry powder. Drops of one or more fluid components of the powder are injected into the input gas stream which can be a carrier gas that does not react with the component(s) of the powder. A mixer can be employed to cause fluid drops emitted by the drop emitting device(s) to merge and form larger drops which are then dried by a dryer. The controller can control operation of the drop emitting device(s) 30 pursuant to information received from an output sensor comprising a particle counter, for example. Input sensor 23 could include a humidity sensor employed to detect humidity of the input gas stream, and the humidity of the input gas stream can be controlled, for example, by using a drop emitting device 30 to inject water drops into the gas stream in the conduit.

A further use of the embodiment of a mixing apparatus illustrated in FIG. 4 would be to analyze an unknown antigen. In such application, the input gas stream 81 contains micro-particles such as polystyrene or latex beads coated with anti-bodies that are known to bind to a reference antigen, and the fluid drops injected into the gas contains the unknown antigen. An input particle counter and an output particle counter would employed, and an output count that is significantly less than the input count would suggest that the antigen matches the reference antigen.

Figure 5:
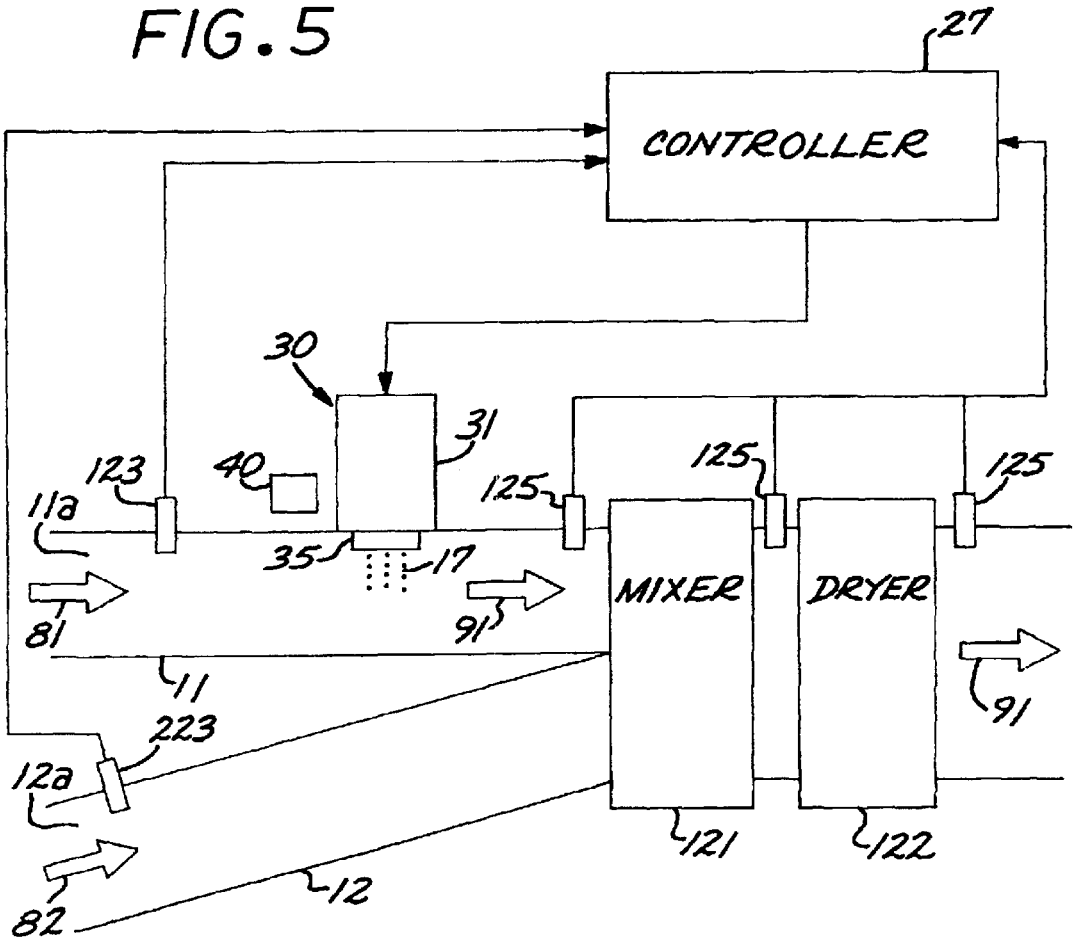
FIG. 5 is a schematic block diagram of a further embodiment of a mixing apparatus that employs a drop on demand fluid drop emitting device.

FIG. 5 is a schematic block diagram of an embodiment of a mixing system that includes a first channel, duct or conduit 11 that that guides a first input gas stream 81 to flow from an input 11 a toward a mixer 121. A drop emitting device 30 emits drops of an additive fluid component 17 into the first input gas stream 81 flowing in the conduit 11 to produce a first gas mixture 91 that contains drops of the fluid additive component 17. The drop emitting device 30 can be like the drop emitting device 30 of an embodiment of a mixing apparatus shown in FIG. 1 and includes a body 31 and a drop on demand fluid drop emitter structure 35 that is supported or housed by the body 31.

The embodiment of a mixing system shown in FIG. 5 further includes a second channel, conduit or duct 12 that guides a second input gas stream 82 to flow from an input 12*a* to the mixer 121. The second input gas stream 82 and the first gas mixture 91 that contains fluid drops of a fluid component 17 are mixed in the mixer 121 to produce a second gas mixture 92. A dryer 122 can be employed to dry the second gas mixture 92.

An input sensor 123 can be employed to detect characteristics or parameters of the first input gas stream 81, while an input sensor 223 can be employed to detect characteristics or parameters of the second input gas stream 82. An output sensor 125 can be employed to detect characteristics of the first gas mixture 91, and one or more output sensors 225 can be employed to detect characteristics of the second gas mixture 92, for example after mixing and/or after drying. A controller 127 controls the operation of the drop emitting device 30. Such control can take into account, for example, information received from any input sensor 123, 223 and/or output sensor 125, 225 that is/are implemented in the mixing system.

The embodiment of a mixing apparatus illustrated in FIG. 5 can be modified to include an off-axis reservoir and a conduit that fluidically connects the drop emitting device 30 to the off-axis reservoir, like the embodiment of a mixing apparatus illustrated in FIG. 2. The embodiment of the mixing apparatus illustrated in FIG. 8 can also be modified to include a plurality of drop emitting devices 30, like the embodiment of a mixing apparatus illustrated in FIG. 3. One or more of such drop emitting devices can be fluidically connected a respective off-axis reservoir like the drop emitting device 30 of the embodiment of a mixing apparatus illustrated in FIG. 2.

A use of the embodiment of a mixing apparatus illustrated in FIG. 5 would be to coat micro-particles to produce coated micro-particles. In such application, the second input gas stream 82 contains micro-particles, and the fluid component 17 comprises a coating material. By way of illustrative example, the micro-particles can comprise latex or polystyrene micro-beads or micro-spheres that are coated with various materials to produce coated micro-particles that are useful in laboratory analyses. As another example, the micro-particles comprise metallic particles such as gold, tungsten or platinum that can be coated with nucleic acid chains to produce coated micro-particles that can be useful for DNA assays or for injecting DNA into a biological system, for example. As further examples, carbon micro-particles can be coated with reactive agents to produce coated micro-particles that are useful in water treatment. Also, glass micro-spheres can be coated for use in chromatography columns.

Figure 6:
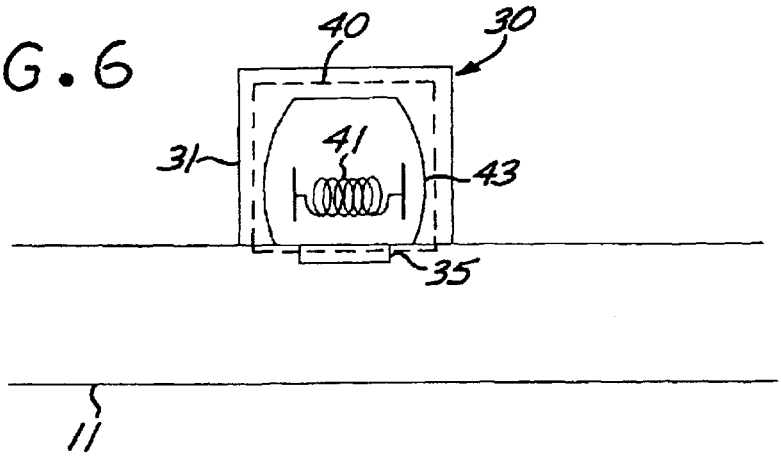
FIG. 6 is schematic block diagram of an embodiment of a drop on demand fluid drop emitting device that includes a pressure control system having a pressure regulating flexible fluid container and spring.

FIG. 6 is a schematic block diagram of an embodiment of a drop emitting device 30 that includes a flexible fluid container 43 such as a bag that is fluidically coupled to the drop emitter structure 35, and a spring 41 that urges the flexible fluid container to expand. The container 43 and the spring 41 form a pressure control system 40 that tends to reduce the pressure in the drop emitter structure relative to the pressure outside the flexible fluid container 43 and in the interior of the body 31 of the drop emitting device 30. If it is desired that the pressure of the fluid in the drop emitting structure 35 be controlled relative to the pressure in the conduit 11, the interior of the body 31 can be fluidically coupled to the interior of the conduit 11, for example by a tube, so that outside of the flexible fluid container 43 is exposed to the pressure in the conduit 11.

FIG. 7 is a schematic block diagram of an embodiment of a drop emitting device 30 that includes a fluid accumulator 33 that is fluidically coupled to the drop emitting structure 35 and receives fluid from a fluid reservoir 39 via a conduit 37 and a valve 45 that controls transfer of fluid from the reservoir 39 to the drop emitting device 30. The fluid reservoir 39 can be pressurized. The valve 45 is controlled by a valve actuator 47 that is responsive to the pressure in the fluid accumulator 33 and the pressure in the interior of the body 31 of the drop emitting device 30. The fluid accumulator 33, the valve 45, and the valve actuator 47 form a pressure control system 40 that controls the pressure of the fluid in the drop emitting structure 35. If it is desired that the pressure of the fluid in the drop emitting structure 35 be controlled relative to the pressure in the conduit 11, the valve actuator 47 can be fluidically coupled to the interior of the conduit 11, for example by a tube, so that valve actuator is exposed to the pressure of the interior of the conduit 11.

FIG. 8 is a schematic block diagram of an embodiment of a drop emitting device 30 that includes a fluid accumulator 33 that is fluidically coupled to the drop emitting structure 35 and receives fluid from a fluid reservoir 39 via a conduit 37 and a valve 45 that controls transfer of fluid from the reservoir 39 to the drop emitting device 30. The fluid reservoir 39 can be pressurized. The valve 45 is controlled by a controller 27 in response to information received from a pressure sensor or transducer 48 that senses pressure in the fluid accumulator 33 and a pressure sensor or transducer 49 that senses pressure in the conduit 11. The pressure transducer 43 can sense the pressure in the interior of the body 31 of the drop emitting device 30 in an embodiment wherein the fluid in the fluid accumulator is at the pressure of the interior of the body 31 of the drop emitting device 30. In this manner, the fluid accumulator, the valve 45, the controller 27, the pressure transducer 48 and the pressure transducer 49 form a pressure control system 40 that controls the pressure of the fluid in the drop emitting structure 35 relative to the pressure in the conduit 11.

Figure 9:
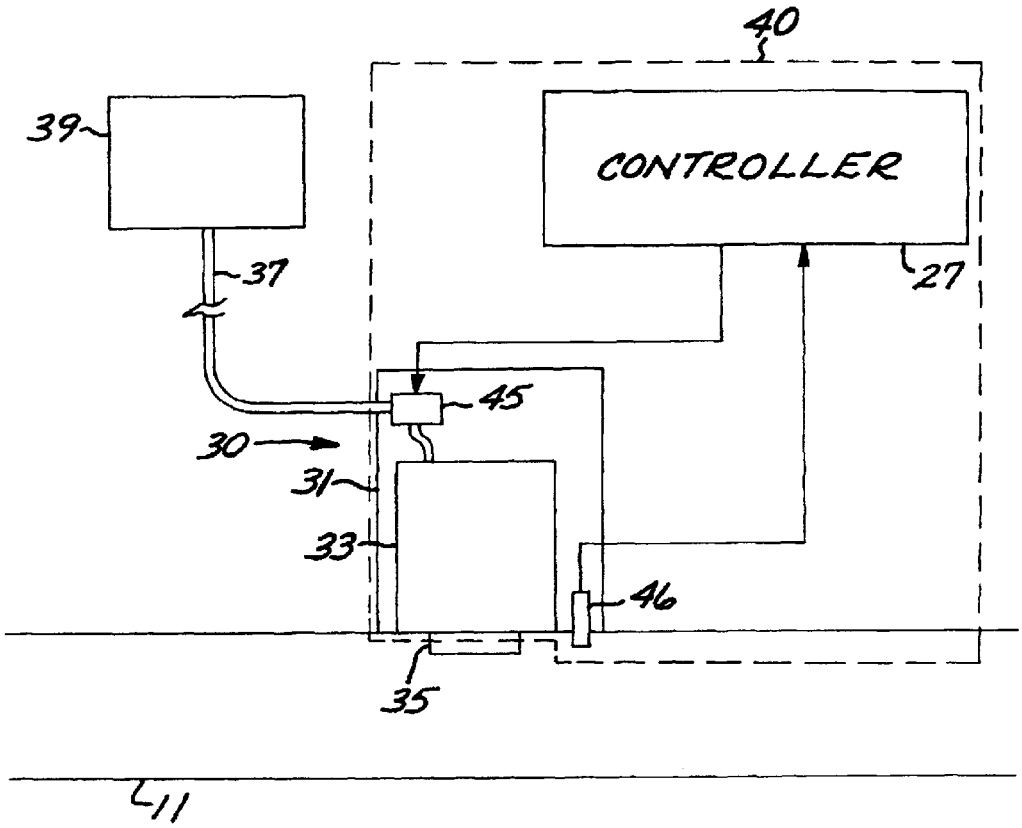
FIG. 9 is a schematic block schematic block diagram of an embodiment of a drop on demand fluid drop emitting device that includes a pressure control system having a pressure regulating valve and a differential pressure transducer.

FIG. 9 is a schematic block diagram of an embodiment of a drop emitting device 30 that includes a fluid accumulator 33 that is fluidically coupled to the drop emitting structure 35 and receives fluid from fluid reservoir 39 via a conduit 37 and a valve 45. The fluid reservoir 39 can be pressurized. The valve 45 is controlled by a controller 27 in response to in response to information received from a differential pressure transducer 46 that senses or responds to a pressure difference between a pressure in the fluid accumulator 33 and a pressure in the conduit 11. The differential pressure transducer 46 can sense the pressure in the interior of the body 31 of the drop emitting device 30 in an embodiment wherein the fluid in the fluid accumulator 33 is at the pressure of the interior of the body 31 of the drop emitting device 30. In this manner, the fluid accumulator, the valve 45, the controller 27 and the differential pressure transducer 46 form a pressure control system that controls the pressure of the fluid in the drop emitting structure 35 relative to the pressure in the conduit 11.

In the embodiments of a drop emitting device 30 illustrated in FIGS. 6–9, the fluid accumulator 33 can be a spring loaded fluid bag or the like which acts like a fluid capacitor so that the valve 45 is not continuously opening and closing.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A mixing apparatus comprising:

a channel for guiding an input gas stream;

a drop on demand fluid drop emitting apparatus for emitting drops of a fluid into said input gas stream to produce a mixture gas stream that contains said fluid drops; and a pressure control system for controlling a pressure of said fluid in said drop on demand fluid drop emitting apparatus relative to a pressure in said channel.

2. The mixing apparatus of claim 1 wherein said drop on demand fluid drop emitting apparatus includes a plurality of electrically addressable drop generators.

3. The mixing apparatus of claim 2 wherein said electrically addressable drop generators comprise thermal drop generators.

4. The mixing apparatus of claim 3 wherein the pressure control system controls the pressure of the fluid in said drop on demand fluid drop emitting apparatus to be positive relative to the pressure in the channel.

5. The mixing apparatus of claim 2 wherein said electrically addressable drop generators comprise piezoelectric drop generators.

6. The mixing apparatus of claim 5, wherein the pressure control system controls the pressure of the fluid in said drop on demand fluid drop emitting apparatus to be positive relative to the pressure in the channel.

7. The mixing apparatus of claim 1 wherein said drop on demand fluid drop emitting apparatus comprises a drop emitter structure that includes a plurality of drop generators.

8. The mixing apparatus of claim 1 wherein said drop on demand fluid drop emitting apparatus comprises a plurality of drop emitter structures each including a plurality of drop generators.

9. The mixing apparatus of claim 1 wherein said drop on demand fluid drop emitting apparatus includes an off-axis reservoir for containing said fluid.

10. The mixing apparatus of claim 9 wherein said pressure control system includes a valve for controlling transfer of fluid from said off-axis reservoir to said drop on demand fluid drop emitting apparatus.

11. The mixing apparatus of claim 1 wherein said pressure control system includes a flexible fluid container and a spring for urging said flexible fluid container to expand.

12. The mixing apparatus of claim 1 wherein said input gas stream contains micro-particles.

13. The mixing apparatus of claim 12 wherein said micro-particles comprise latex micro-particles.

14. The mixing apparatus of claim 12 wherein said micro-particles comprise metallic micro-particles.

15. The mixing apparatus of claim 1 further including a mixer for mixing said mixture gas stream that contains said fluid drops.

16. The mixing apparatus of claim 1 further including a dryer for drying said mixture gas stream that contains said fluid drops.

17. A mixing apparatus comprising:

a channel for guiding an input gas stream;

a drop on demand fluid drop emitting apparatus for emitting drops of a fluid into said input gas stream to produce a mixture gas stream that contains said fluid drops; and a pressure control system for controlling a pressure of said fluid in said drop on demand fluid drop emitting apparatus, wherein said pressure control system includes a pressure transducer for sensing said pressure of said fluid in said drop on demand drop emitting apparatus, and a pressure transducer for sensing a pressure in said channel.

18. A mixing apparatus comprising:

a channel for guiding an input gas stream;

a drop on demand fluid drop emitting apparatus for emitting drops of a fluid into said input gas stream to produce a mixture gas stream that contains said fluid drops; and a pressure control system for controlling a pressure of said fluid in said drop on demand fluid drop emitting apparatus, wherein said pressure control system includes a differential pressure transducer for sensing a difference between said pressure of said fluid in said drop on demand drop emitting apparatus and a pressure in said channel.

19. A mixing apparatus comprising:

a first channel for guiding a first gas stream;

a drop on demand fluid drop emitting device for emitting drops of a fluid into said first gas stream to produce a first gas mixture;

a pressure control system for controlling a pressure of said fluid in said drop on demand fluid drop emitting device;

a second channel for guiding a second gas stream; and a mixer for mixing said second gas stream with said first gas mixture to produce a second gas mixture.

20. The mixing apparatus of claim 19 wherein said drop on demand fluid drop emitting apparatus includes a plurality of electrically addressable drop generators.

21. The mixing apparatus of claim 20 wherein said electrically addressable drop generators comprise thermal drop generators.

22. The mixing apparatus of claim 20 wherein said electrically addressable drop generators comprise piezoelectric drop generators.

23. The mixing apparatus of claim 19 wherein said drop on demand fluid drop emitting apparatus comprises a drop emitter structure that includes a plurality of drop generators.

24. The mixing apparatus of claim 19 wherein said drop on demand fluid drop emitting apparatus comprises a plurality of drop emitter structures each including a plurality of drop generators.

25. The mixing apparatus of claim 19 wherein said drop on demand fluid drop emitting apparatus includes an off-axis reservoir for containing said fluid.

26. The mixing apparatus of claim 25 wherein said pressure control system includes a valve for controlling transfer of fluid from said off-axis reservoir to said drop on demand fluid drop emitting apparatus.

27. The mixing apparatus of claim 19 wherein said pressure control system includes a flexible fluid container and a spring for urging said flexible fluid container to expand.

28. The mixing apparatus of claim 19 wherein said pressure control system includes a pressure transducer for sensing said pressure of said fluid in said drop on demand fluid drop emitting apparatus, and a pressure transducer for sensing a pressure in said channel.

29. The mixing apparatus of claim 19 wherein said pressure control system includes a differential pressure transducer for sensing a difference between said pressure of said fluid in said drop on demand fluid drop emitting apparatus and a pressure in said first channel.

30. The mixing apparatus of claim 19 wherein said second gas stream contains micro-particles.

31. The mixing apparatus of claim 30 wherein said micro-particles comprise latex micro-particles.

32. The mixing apparatus of claim 30 wherein said micro-particles comprise metallic micro-particles.

33. A mixing apparatus comprising:

a channel for guiding an input gas stream;

a drop on demand fluid drop emitting apparatus for emitting drops of a fluid into said input gas stream to produce a gas mixture;

said drop on demand fluid drop emitting apparatus including a plurality of electrically addressable drop generators;

a pressure control system for controlling a pressure of said fluid in said drop on demand fluid drop emitting apparatus relative to a pressure in said channel;

an input sensor for sensing a characteristic of said input gas stream; and a controller responsive to said input sensor for controlling said drop on demand fluid drop emitting apparatus.

34. A mixing apparatus comprising:

a channel for guiding an input gas stream;

a drop on demand fluid drop emitting apparatus for emitting drops of a fluid into said input gas stream to produce a gas mixture;

said drop on demand fluid drop emitting apparatus including a plurality of electrically addressable drop generators;

a pressure control system for controlling a pressure of said fluid in said drop on demand fluid drop emitting apparatus relative to a pressure in said channel;

an output sensor for sensing a characteristic of said gas mixture; and a controller responsive to said output sensor for controlling said drop on demand fluid drop emitting apparatus.

35. A mixing apparatus comprising:

a channel for guiding an input gas stream;

a drop on demand fluid drop emitting apparatus for emitting drops of a fluid into said input gas stream to produce a gas mixture;

said drop on demand fluid drop emitting apparatus including a plurality of electrically addressable drop generators;

a pressure control system for controlling a pressure of said fluid in said drop on demand fluid drop emitting apparatus relative to a pressure in said channel;

a dryer for drying said gas mixture;

an output sensor for sensing a characteristic of said gas mixture; and a controller responsive to said output sensor for controlling said drop on demand fluid drop emitting apparatus.

36. A mixing apparatus comprising:

means for guiding a gas stream;

means for emitting drops of a fluid into said first gas stream to produce a gas mixture that includes said fluid; and means for controlling said a pressure of said fluid in said means for emitting drops relative to a pressure in said means for guiding a gas stream.

37. A mixing apparatus comprising:

a channel for guiding an input gas stream;

a drop on demand fluid drop emitting apparatus for emitting drops of a fluid into said input gas stream to produce a gas mixture;

said drop on demand fluid drop emitting apparatus including a plurality of electrically addressable drop generators;

a pressure control system for controlling a pressure of said fluid in said drop on demand fluid drop emitting apparatus relative to a pressure in said channel;

an input sensor for sensing a characteristic of said input gas stream; and a controller responsive to said input sensor for controlling said drop on demand fluid drop emitting apparatus.

38. A mixing apparatus comprising:

a channel for guiding an input gas stream;

a drop on demand fluid drop emitting apparatus for emitting drops of a fluid into said input gas stream to produce a gas mixture;

said drop on demand fluid drop emitting apparatus including a plurality of electrically addressable drop generators;

a pressure control system for controlling a pressure of said fluid in said drop on demand fluid drop emitting apparatus relative to a pressure in said channel;

an output sensor for sensing a characteristic of said gas mixture; and a controller responsive to said output sensor for controlling said drop on demand fluid drop emitting apparatus.

39. A mixing apparatus comprising:

a channel for guiding an input gas stream;

a drop on demand fluid drop emitting apparatus for emitting drops of a fluid into the input gas stream to produce a mixture gas stream that contains the fluid drops;

a differential pressure transducer for sensing a pressure difference between a pressure of the fluid in the drop on demand fluid drop emitting apparatus and a pressure in the conduit; and a pressure control system responsive to the differential pressure transducer for controlling the pressure of the fluid in said drop on demand fluid drop emitting apparatus.

* * * * *

UNITED STATES PATENT AND TRADEMARK OFFICE

CERTIFICATE OF CORRECTION

PATENT NO. : 6,799,882 B2
DATED : October 5, 2004
INVENTOR(S) : Childers et al.

It is certified that error appears in the above-identified patent and that said Letters Patent is hereby corrected as shown below:

Column 7,
Line 42, delete "positive" and insert therefor -- negative --.

Signed and Sealed this

Twenty-ninth Day of March, 2005

JON W. DUDAS
*Director of the United States Patent and Trademark Office*